US008104585B2

(12) United States Patent
Smith et al.

(10) Patent No.: US 8,104,585 B2
(45) Date of Patent: Jan. 31, 2012

(54) METHOD OF ASSIGNING HALL CALLS BASED ON TIME THRESHOLDS

(75) Inventors: Rory Smith, El Cajon, CA (US); Richard Peters, Great Kingshill (GB)

(73) Assignee: Thyssenkrupp Elevator Capital Corporation, Troy, MI (US)

( * ) Notice: Subject to any disclaimer, the term of this patent is extended or adjusted under 35 U.S.C. 154(b) by 708 days.

(21) Appl. No.: 12/200,220

(22) Filed: Aug. 28, 2008

(65) Prior Publication Data

US 2009/0133967 A1 May 28, 2009

Related U.S. Application Data

(60) Provisional application No. 60/968,374, filed on Aug. 28, 2007.

(51) Int. Cl.
*B66B 1/18* (2006.01)

(52) U.S. Cl. ..... 187/382; 187/247

(58) Field of Classification Search ..... 187/247, 187/248, 380–389, 391–393, 396
See application file for complete search history.

(56) References Cited

U.S. PATENT DOCUMENTS 5,024,295 A * 6/1991 Thangavelu ..... 187/382
5,239,142 A * 8/1993 Ekholm et al. ..... 187/387
5,304,752 A * 4/1994 Hayashi ..... 187/384
5,672,853 A * 9/1997 Whitehall et al. ..... 187/380
5,865,274 A * 2/1999 Kiji et al. ..... 187/380
6,241,050 B1 * 6/2001 Hikita et al. ..... 187/386
7,475,757 B2 * 1/2009 Valk et al. ..... 187/382

FOREIGN PATENT DOCUMENTS

WO WO 02/49950 6/2002
WO WO 2004/031062 4/2004
WO WO 2005/042389 5/2005
WO WO 2005/100223 10/2005

* cited by examiner

*Primary Examiner* — Anthony Salata
(74) *Attorney, Agent, or Firm* — Frost Brown Todd LLC

(57) ABSTRACT

A method for assigning an elevator car to respond to a call signal includes a controller that determines which elevator car will respond to the call signal based on certain wait time thresholds. The controller receives a hall call signal, and the controller is programmed with wait time thresholds that can include, e.g., an estimated wait time (EWT), and/or estimated travel time (ETT). In this example, these thresholds are time values above which a passenger is likely to become impatient, either waiting for an elevator car to arrive, or waiting for their elevator car to arrive at its destination. Based on system information an EWT and ETT are calculated and compared to the thresholds. An elevator car is assigned based on this comparison. In some versions, an estimated time to destination (ETD) is used in determining which elevator car to assign. In some versions, a handling capacity coefficient (HCx), which reflects current traffic conditions, is used in determining which elevator car to assign.

7 Claims, 10 Drawing Sheets

| Elevator | Car A | Car B | Car C | | Car D |
|---|---|---|---|---|---|
| Location (floor) | Lobby | 3rd Floor | 7th Floor | | 18th |
| Direction | UP (↑) | UP (↑) | UP (↑) | | DOWN (↓) |
| Current Passenger(s) & Destinations | Passenger A (18th Floor) | Passenger B-1 (9th Floor) | Passenger C-1 (18th Floor) | Passenger C-2 (18th Floor) | Passenger D (Lobby) |
| Current Waiting Passengers Assigned To Elevator & Destination | None | Passenger B-2 (Waiting on the 9th Floor to travel to the 25th floor) | None | | None |

FIG. 5

| ELEVATOR | Car A | Car B | Car C | Car D |
|---|---|---|---|---|
| $SDF_K$ (seconds) | 10 | 10 | 20 | 0 |
| EWT (seconds) | 12 | 19.6 | 4.8 | 36.4 |
| ETT (seconds) | 23.8 | 13.8 | 23.8 | 13.8 |
| ETD (seconds) | 35.8 | 33.4 | 28.6 | 50.2 |
| $HC_x$ | 1 | 1 | 1 | 1 |
| CC (seconds) | 45.8 | 43.4 | 48.6 | 50.2 |
| Car Assigned | | X | | |

FIG. 6

| ELEVATOR | Car A | Car B | Car C | Car D |
|---|---|---|---|---|
| $SDF_K$ (seconds) | 10 | 10 | 20 | 0 |
| EWT (seconds) | 12 | 19.6 | 4.8 | 36.4 |
| ETT (seconds) | 23.8 | 13.8 | 23.8 | 13.8 |
| Original ETD (seconds) | 35.8 | 33.4 | 28.6 | 50.2 |
| $HC_x$ | 0.75 | 0.75 | 0.75 | 0.75 |
| Modified ETD | 29.85 | 29.95 | 22.65 | 46.75 |
| CC (seconds) | 39.85 | 39.95 | 42.65 | 46.75 |
| Car Assigned | X | | | |

FIG. 7

| ELEVATOR | Car A | Car B | Car C | Car D |
|---|---|---|---|---|
| $SDF_K$ (seconds) | 10 | 10 | 20 | 0 |
| EWT (seconds) | 12 | 19.6 | 4.8 | 36.4 |
| ETT (seconds) | 23.8 | 13.8 | 23.8 | 13.8 |
| Original ETD (seconds) | 35.8 | 33.4 | 28.6 | 50.2 |
| $HC_x$ | 0.5 | 0.5 | 0.5 | 0.5 |
| Modified ETD | 23.9 | 26.5 | 16.7 | 43.3 |
| CC (seconds) | 33.9 | 36.5 | 36.7 | 43.3 |
| Car Assigned | X | | | |

FIG. 8

| ELEVATOR | Car A | Car B | Car C | Car D |
|---|---|---|---|---|
| $SDF_K$ (seconds) | 10 | 10 | 20 | 0 |
| EWT (seconds) | 12 | 19.6 | 4.8 | 36.4 |
| ETT (seconds) | 23.8 | 13.8 | 23.8 | 13.8 |
| Original ETD (seconds) | 35.8 | 33.4 | 28.6 | 50.2 |
| $HC_x$ | 0 | 0 | 0 | 0 |
| Modified ETD | 12 | 19.6 | 4.8 | 36.4 |
| CC (seconds) | 22 | 29.6 | 24.8 | 36.4 |
| Car Assigned | X | | | |

FIG. 9

| ELEVATOR | Car A | Car B | Car C | Car D |
|---|---|---|---|---|
| $SDF_K$ (seconds) | 10 | 10 | 20 | 0 |
| EWT (seconds) | 12 | 19.6 | 4.8 | 36.4 |
| ETT (seconds) | 23.8 | 13.8 | 23.8 | 13.8 |
| Original ETD (seconds) | 35.8 | 33.4 | 28.6 | 50.2 |
| Handling Capacity | 0.5 | 0.5 | 0.5 | 0.5 |
| Modified ETD | 23.9 | 26.5 | 16.7 | 43.3 |
| Modified SDFK | 5 | 5 | 10 | 0 |
| CC (seconds) | 28.9 | 31.5 | 26.7 | 43.3 |
| Car Assigned | | | X | |

FIG. 10

METHOD OF ASSIGNING HALL CALLS BASED ON TIME THRESHOLDS

PRIORITY

The application claims priority from the disclosure of U.S. Provisional Patent Application Ser. No. 60/968,374, entitled "Method and Apparatus to Reduce Waiting Times for Destination Based Dispatching Systems," filed Aug. 28, 2007, which is herein incorporated by reference in its entirety.

FIELD OF THE INVENTION

The present disclosure relates in general to elevators and, in particular, to control systems governing the operation of elevator systems.

BACKGROUND OF THE INVENTION

Existing hall call allocation systems and methods use criteria, such as waiting time, time to destination, energy consumption, and elevator usage, with neural networks, generic algorithms, and/or fuzzy logic to find an optimum solution for assigning a new hall call to one of a group of available elevator cars. These existing systems and methods generally fall into one of two categories: Estimate Time of Arrival ("ETA") based systems and destination dispatch based systems.

Existing systems and methods often have shortcomings that limit their efficiencies. ETA based systems calculate the amount of time required for each available elevator to answer a new hall call. The elevator with the lowest time required to answer the call, i.e. the car that will arrive first, is assigned the new hall call. While ETA based systems have some advantages, they do not adequately evaluate the negative impact of a new hall call assignment on existing call assignments. For example, when a passenger enters a new hall call and it is accepted by an elevator car carrying existing passengers that are traveling to a floor beyond the floor where the newly assigned hall call was entered, the existing passengers will be delayed by the time needed to pick up the new passenger and depending upon the new passenger's desired destination, the existing passengers may be delayed by the time needed to drop off the new passenger.

Destination dispatch systems also have shortcomings. For example, they often require a destination input device at each elevator landing and usually have no call input devices in the elevator car. Because destination dispatch systems require entry devices at every elevator landing, they must make an instant call assignment and inform a waiting passenger which car to enter. This instant assignment does not permit an improved assignment if conditions change during the time period between call entry and car arrival. Thus, an elevator hall call assignment system and method that does not require destination entry devices at every elevator landing and that takes into account the delay that a new hall call assignment will have on existing passengers would greatly improve the elevator car.

Studies have suggested that the inconvenience of delay perceived by elevator passengers is based on the type of waiting they are subjected to in addition to the time delay. For example, passengers generally become impatient if they must wait more than thirty seconds to board an elevator and if they have to wait more than ninety seconds for the elevator to reach its destination. ETA systems attempt to reduce the overall waiting time required for passengers to reach their destination, but do not account for the differences in perceived inconvenience associated with different types of waiting. It would therefore be advantageous to provide an elevator system that accounts for these different types of waiting periods in dispatching elevators.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings:

FIG. 5 shows a table containing sample data relating to the operation of one version of an elevator system.

FIG. 6 shows a table containing sample data relating to the operation of the version of the elevator system relating to FIG. 5.

FIG. 7 shows a table containing sample data relating to the operation of the version of the elevator system relating to FIG. 5.

FIG. 8 shows a table containing sample data relating to the operation of the version of the elevator system relating to FIG. 5.

FIG. 9 shows a table containing sample data relating to the operation of the version of the elevator system relating to FIG. 5.

FIG. 10 shows a table containing sample data relating to the operation of the version of the elevator system relating to FIG. 5.

DETAILED DESCRIPTION OF THE INVENTION

Figure 1:
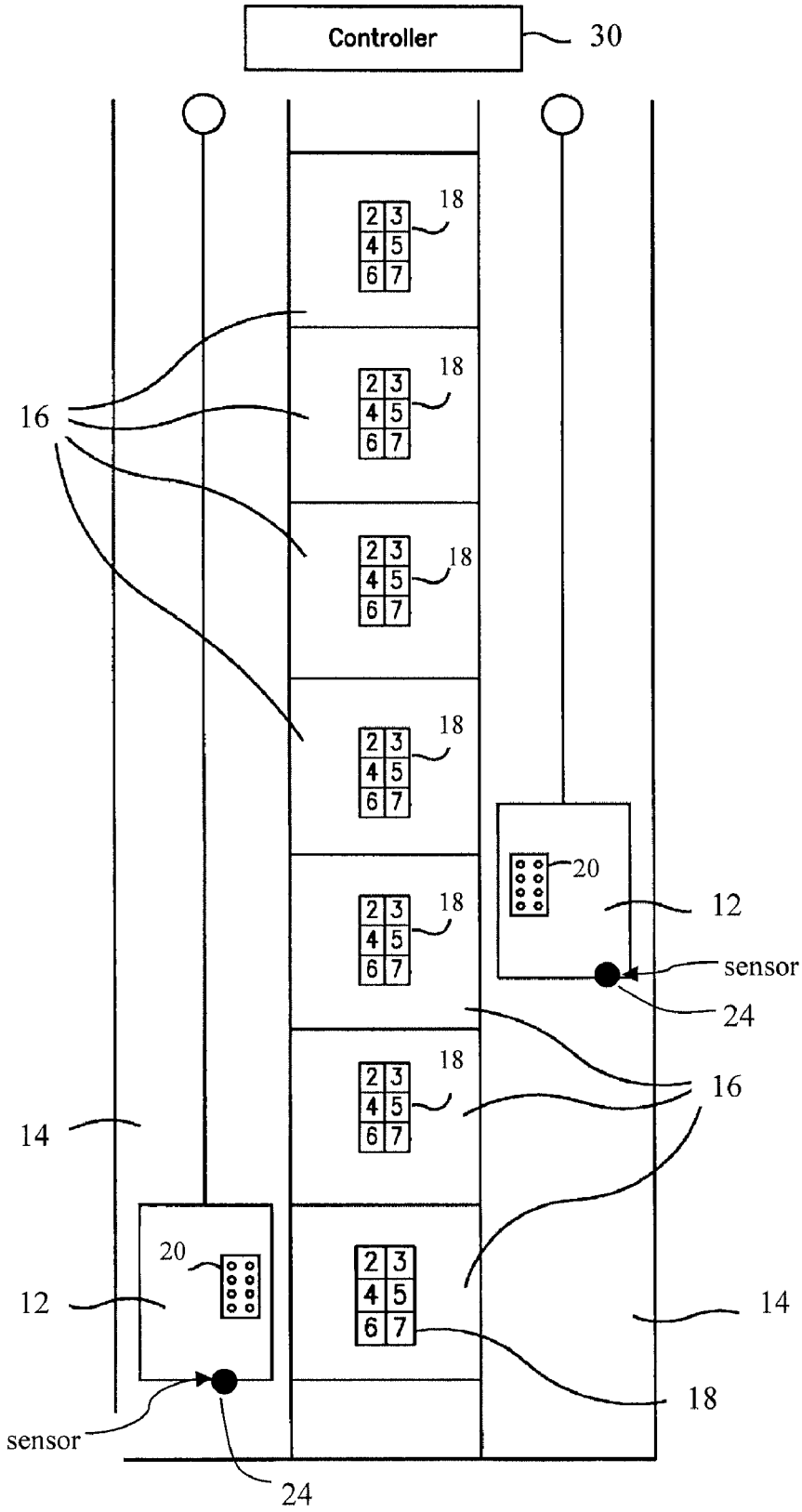
FIG. 1 shows a perspective view of one version of an elevator system.

The following description of certain examples of the current application should not be used to limit the scope of the present invention as expressed in the appended claims. Other examples, features, aspects, embodiments, and advantages of the invention will become apparent to those skilled in the art from the following description. Accordingly, the figures and description should be regarded as illustrative in nature and not restrictive.

Studies have suggested that the inconvenience of delay perceived by elevator passengers is based on the type of waiting they are subjected to in addition to the actual time delay experienced. For example, passengers generally become impatient if they must wait more than thirty seconds to board an elevator and if they have to wait more than ninety seconds for the elevator to reach its destination. Thus, it can be inferred that the patients perceive time spent waiting for an elevator as being more onerous or inconvenience than time spent actually riding in an elevator.

Versions of elevator systems described herein may improve a passenger's perception of ride efficiency by accounting for different levels of inconvenience associated with different types of waiting. This may even be accomplishing by delaying the overall time required for the passenger's car to reach their destination while giving the passenger the impression that the ride is actually more efficient. Existing ETA based systems may allow any suitable proportion of estimated waiting time (ETW) and estimated travel time (ETT) needed to reduce a passenger's overall estimated time to destination (ETD), which is ETW plus ETT, as much as possible. For example, an ETA based system may increase a passenger's ETW, the time a passenger waits for an elevator car to arrive, to 35 seconds in order to reduce the passenger's overall ETD. In the whole scenario, ETW may be 35 seconds, ETT may be 60 seconds, and the total ETD may be 95 seconds. Based upon the results of current studies, passengers likely would have become impatient waiting more than 30 seconds for their car to arrive. Passing the 30 second threshold may give them the impression that the elevator system is slow and inefficient.

Elevator systems described herein may seek to determine whether a scenario is available that gives a passenger the perception that the elevator system is timely and efficient. For example, rather than selecting the scenario described previously, it may be possible to reduce the ETW to 25 seconds, increase the ETT to 75 seconds, for a total ETD of 100 seconds. Although this is a longer overall travel time for the passenger, the ETW is below the 30 second threshold and the ETT is below the 90 second threshold. Thus, it is likely that the passenger will actually experience the latter scenario as being more efficient than what was actually the faster scenario. An ETA based system likely would not select what the passenger would perceive as the better ride due to the longer overall wait time.

Although extending the ETD to improve the perception of ride efficiency may be possible during off-peak time, the reduction in handling capacity of the overall system may make this impractical during peak hours. During increased periods of traffic, such as lunchtime, longer travel periods may reduce the overall efficiency of the system, where limiting the duration of travel by passengers is important for ensuring that elevators are accessible to respond to future call signals. Decreasing the wait times for passengers, while increasing the overall travel time for passengers, may cause an elevator system to operate inefficiently. Thus, it may be advantageous to incorporate an element into the control algorithm to account for different elevator environments.

Referring now to the drawings in detail, wherein like numerals indicate the same elements throughout the views, FIG. 1 depicts one version of an elevator system (10). The elevator system (10) includes multiple elevator cars (12) positioned within a plurality of elevator shafts (14). The elevator cars (12) travel vertically within the respective shafts (14) and stop at a plurality of landings (16). As depicted in the example, each of the various landings (16) includes an external destination entry device (18). The elevator cars (12) include internal destination entry devices (20). Examples of destination entry devices include interactive displays, computer touch screens, or any combination thereof. Still, other structures, components, and techniques for destination entry devices are well known and may be used. Yet further, traditional up/down call signals may be used at a landing.

As shown in the example of FIG. 1, an elevator (10) is shown that is governed by a controller (30). It will be appreciated that versions of the controller (30) and the elevator (10) are described by way of example only and that various suitable systems, techniques, and components may be used to govern the movement of the elevator cars (12). In one version, the controller (30) is a computer-based control system configured to assign new hall calls to one of a plurality of elevator cars.

Figure 2:
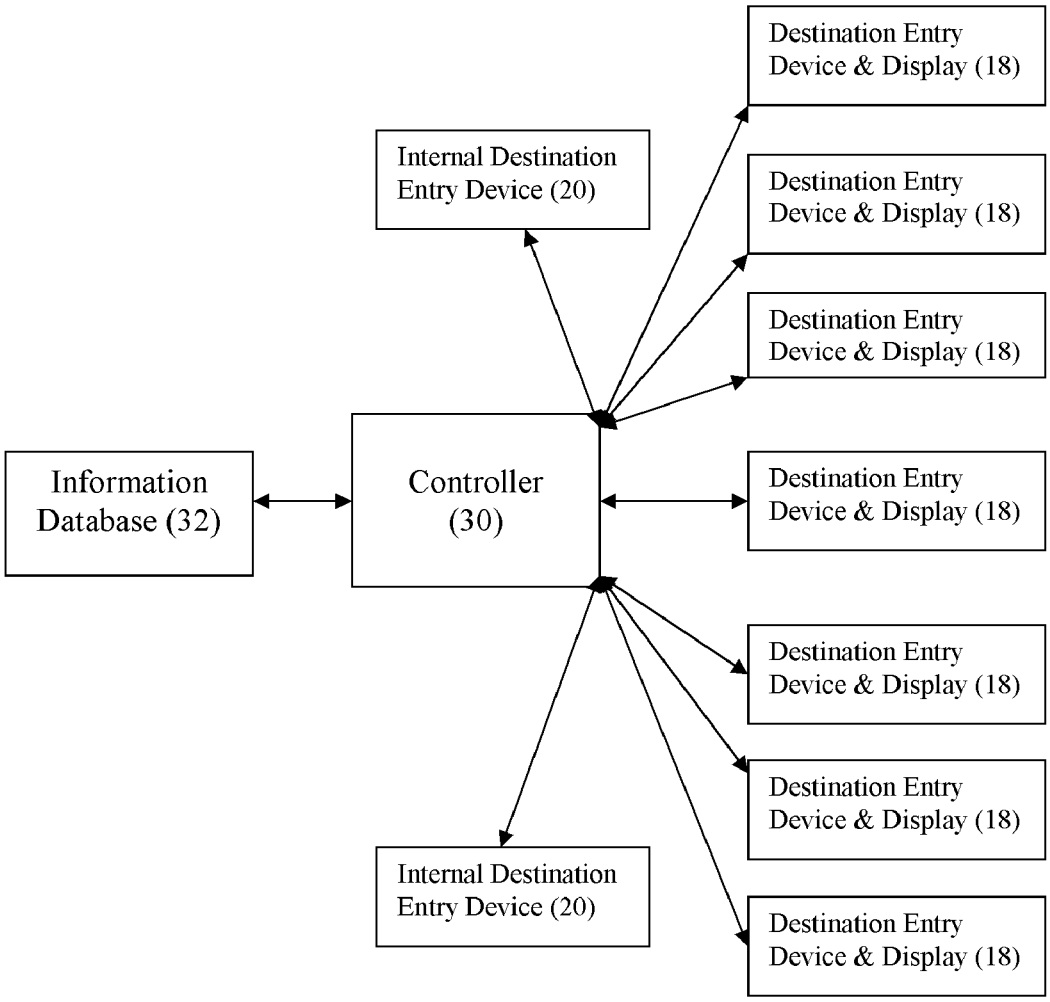
FIG. 2 shows a schematic depicting one version of a controller system governing the operation of the elevator system of FIG. 1.

As shown in FIG. 2, the controller (30) may receive a plurality of suitable inputs from an information database (32) to aid in governing the assignment of hall calls. The controller (30) is configured to receive inputs from a plurality of destination entry devices (18), (20) to aid in governing the movement of the elevator cars (12). Examples of such inputs received by the controller (30) may include, but are not limited to, new destination calls from passengers, the status of each elevator, the current time, an average speed for an elevator, elevator load sensor information, elevator acceleration, and a designated handling capacity value. Values may be preprogrammed, measured, or include combinations thereof. For example, average elevator speed may be pre-programmed and elevator weight may be measured by a load sensor during operation. It will be appreciated that any suitable configuration of the controller (30) with various entry devices (18), (20) is contemplated.

The controller (30) may also include pre-programmed data-handling information and algorithms to facilitate management of the data received. For example, the controller (30) may receive information from a load cell indicating the overall passenger weight of an elevator car. The controller (30) may be pre-programmed to estimate the number of individuals within an elevator car based upon total weight and/or the approximate available capacity. As will be described in more detail, the controller may also contain pre-programming associated with ETW, ETT, ETD, system degradation factors (SDF), elevator handling capacity (HC), and/or any other suitable factors.

Figure 3:
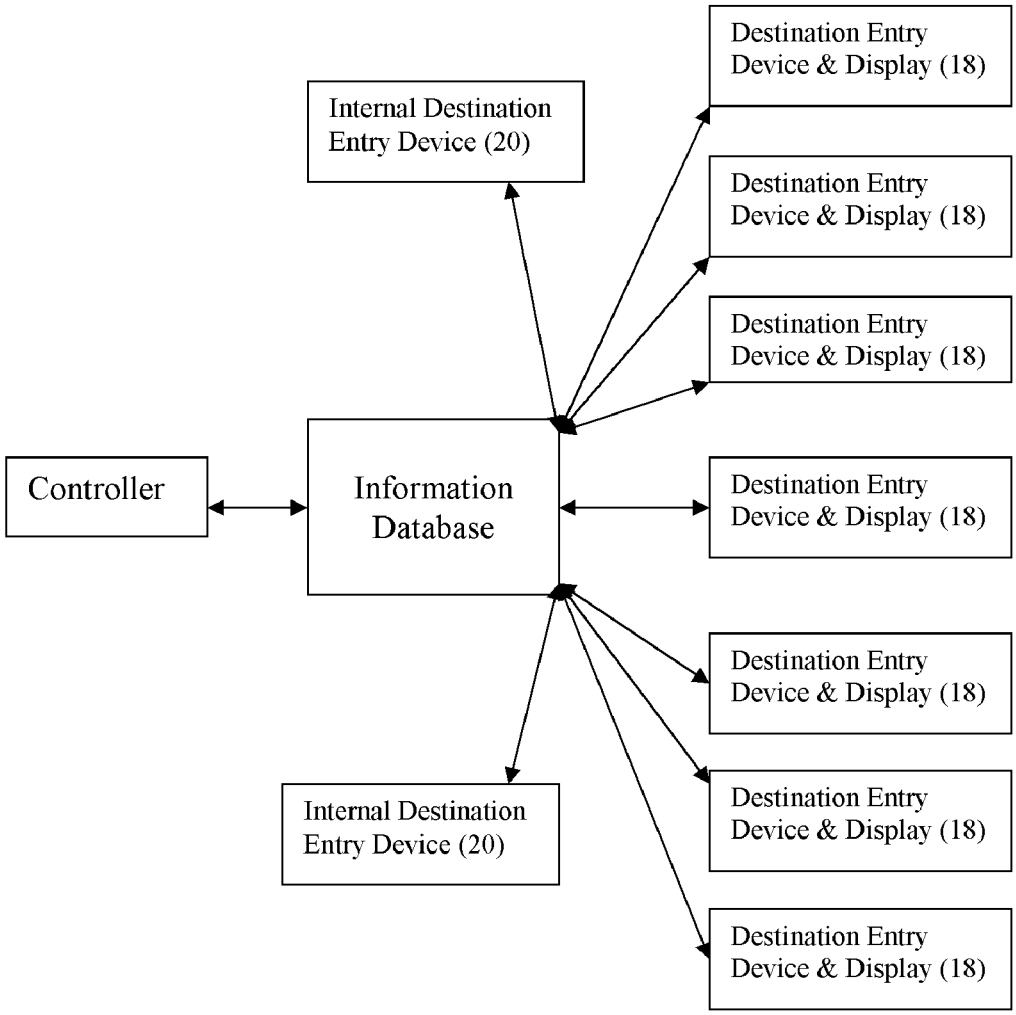
FIG. 3 shows a schematic depicting an alternate version of a controller system governing the operation of the elevator system of FIG. 1.

FIG. 3 illustrates an alternate configuration of the controller (30). In this configuration, the controller (30) sends and receives input from the information database (32). In contrast to FIG. 2, the information database (32) receives inputs from the sensors (24) and the destination entry devices (18), (20). Upon command from the controller (30), the information database (32) sends data to the controller (30).

In one version, the controller (30) is tasked with assigning elevator cars (12) to a call signal based upon a calculated Call Cost ("CC") for each elevator car. The controller (30) calculates the CC for each elevator car whenever a new call signal is activated to determine which elevator to assign to the call. CC calculations may be made at regular intervals, upon initiation of a hall call, during an elevator car's travel, and/or at any other suitable time. Once calculated, the controller (30) sends the elevator car (12) with the lowest CC to respond to the call signal. One method of calculating a CC is described in U.S. Pat. No. 6,439,349, the disclosure of which is incorporated herein by reference in its entirety.

One version for calculating a call cost for an elevator car, as shown in Equation 1 below, includes adding a value for the System Degradation Factors ("SDFs") to the value of the estimated time to the actual destination ("ETD"):

$$CC = \sum_{k=1}^{n} SDF_k + ETD \tag{1}$$

wherein the elevator car has a quantity of (n) existing cars and hall calls (k).

In this version, the SDF for an existing hall call is a function of the delay that one or more passengers traveling on the elevator car will experience as a result of the car's acceptance of the new hall call. Each passenger is assigned a value for SDF. Other waiting passengers, who have already been assigned to an elevator and will be riding the elevator when the waiting passenger who activated the call signal is picked up, may also be assigned a value for SDF. Likewise, an SDF value may be assigned to the waiting passenger who activated the call signal particularly where the waiting passenger would be subject to being delayed by current or known future passengers departing or entering the elevator.

The term passenger may be used to define a single passenger or a group of passengers. For example, if three individuals enter a single elevator car at the $19^{th}$ floor after selecting the $32^{nd}$ and $41^{st}$ floors on the external destination device, the controller (30) may separate the passengers into a passenger group for the $32^{nd}$ floor and a passenger group for the $41^{st}$ floor. Therefore, it is possible in some versions of this system that the term passenger refers to more than one passenger when referring to the value calculated for SDF.

As mentioned earlier, the term ETD references the estimated time to the actual destination for the waiting passenger. In at least one version of a system, the value for ETD includes the Estimated Waiting Time ("EWT") and the Estimated Traveling Time ("ETT") as shown below in equation (2).

$$CC = \sum_{k=1}^{n} SDF_k + (EWT + ETT) \tag{2}$$

The value of EWT equals the time that elapses from the registration of a destination call by a passenger until an elevator arrives to pick up the waiting passenger. The value of ETT equals the time period lasting from the end of the EWT period (i.e. when the elevator doors open to pick up the waiting passenger) until the passenger arrives at the destination. In systems using destination entry devices when activating call signals, the destination selected by the waiting passenger will be used when calculating a value for ETD.

For those systems using up/down call signals, a value for ETID is substituted for ETD. In this version, ETID is referred to as the estimated time to the inferred destination. Destinations may be inferred from statistical data including the time of the day, floor of departure, and so on. The values for EWT and ETT are calculated using this inferred destination. Any suitable data, such as algorithms to determine inferred destinations, may be incorporated into the controller (30).

For example, assume a waiting passenger at the $15^{th}$ floor selects the $30^{th}$ floor on an external destination entry device. The controller (30) receives the call signal and begins determining which elevator car to assign. Assuming each floor measures 4 meters in height, the distance between the $15^{th}$ floor and $30^{th}$ floor is 60 meters. The controller (30) begins calculating a CC for an elevator car ascending from the lobby with two passengers who have respectively selected the $20^{th}$ and $26^{th}$ floors as their destinations. The elevator car has an average velocity of 3 m/s. In this version, the CC value for this elevator is a combination of the values of SDF and ETD.

The ETD when calculating CC for this car equals 60 seconds. The value of ETD is equal to 60 seconds because the values for EWT and ETT respectively equal 20 seconds and 40 seconds. EWT equals 20 seconds because this is the calculated time necessary for the elevator to travel from the lobby to the $15^{th}$ floor to pick up the waiting passenger. ETT equals 40 seconds because this is the calculated time necessary for the waiting passenger to arrive at the $30^{th}$ floor after leaving the departure floor. ETT includes the 20 seconds necessary to travel non-stop from the $15^{th}$ floor to the $30^{th}$ floor, as well as 10 seconds for each stop at the $20^{th}$ and $26^{th}$ floors to drop off the passengers who entered the elevator at the lobby. Obviously, different values may be used for variables such as the average velocity and the average time necessary to stop at a floor.

In this example, the value of $SDF_k$ for this elevator car would equal 20 seconds. As mentioned earlier, a separate SDF value is calculated for each existing passenger. In this example, there are currently two passengers. Each passenger will be present on the elevator only when the waiting passenger is picked up, not when the waiting passenger is dropped off. Assuming each passenger will be delayed 10 seconds in order to pick up the waiting passenger, each current passenger's value of SDF is 10 seconds.

Combining the 60-second value of ETD with the 20-second value of $SDF_k$, produces a CC equaling 80 seconds. Upon calculating this CC value for this elevator, the controller (30) may calculate the remaining CC values for at least one other elevator. The controller (30) may award the elevator with the lowest CC to respond to a call signal. In another version, the controller (30) may automatically assign an elevator car to respond to a call signal if the calculated CC value is below a specified threshold.

The handling capacity of an elevator system generally refers to the capacity of the elevator equipment to handle various numbers of people, the efficiency of the control system, and the building characteristics such as the number of floors and distance between floors. Elevator systems have a maximum handling capacity, but the handling capacity can also be reduced based on the mode of operation selected by the controller (30). Maximum handling capacity may be necessary during peak operating periods, but during off-peak times it may be advantageous to reduce the overall handling capacity of the system. For example, in accordance with versions described herein, longer ETD periods may actually result in the perception of a more efficient ride. However, extending the overall length of a passenger's ride will decrease the overall handling capacity of the elevator system. This will only be advantageous during off-peak times. Thus, it would be advantageous to provide controller (30) with an algorithm to adjust the handling capacity of the system based upon the current traffic type.

For example, one version of the elevator system incorporates a handling capacity coefficient, $HC_x$, that may vary the emphasis placed on the various factors used to calculate CC based upon traffic type. One version of an equation for CC may read as shown below in equation (3):

$$CC = \sum_{k=1}^{n} SDF_k + EWT + (HC_x \times ETT) \tag{3}$$

$HC_x$ represents a value associated with the handling capacity of an elevator car to reflect the current traffic conditions of an elevator system. It will be understood by those skilled in the art that any suitable value may be used for $HC_x$. Likewise, it will be understood by those skilled in the art that a value for $HC_x$ may correspond to a particular condition related to handling capacity during the elevator's operation. For example, the values of $HC_x$ may vary from a value of 0 when there is no elevator traffic to a value of 1 when the elevator system is operating at full capacity. Incorporating a value for handling capacity will allow for the system to provide passengers with the perception of a highly efficient ride during off-peak hours and to maximize efficiency during peak hours when needed. Thus, the perception of efficiency may be sacrificed for actual efficiency during peak times.

Figure 4:
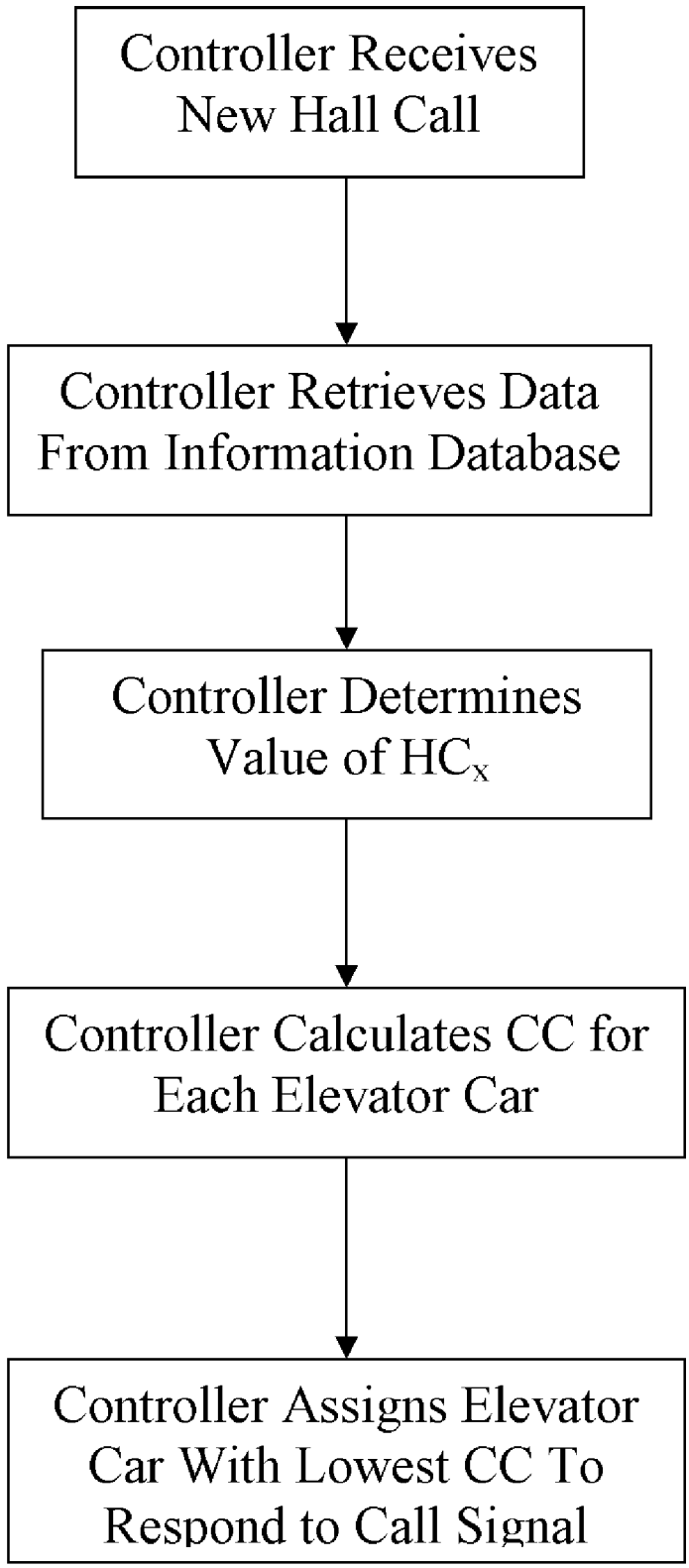
FIG. 4 shows a flowchart depicting one version of a method for assigning a new call.

FIG. 4 depicts a flowchart showing one version of the steps for assigning a hall call incorporating $HC_x$ into the CC calculation. In this version, the controller (30) receives an input in the form of an activated call signal. The controller (30) obtains data from the information database (32) regarding the elevator system (10) and the activated call signal. For example, the controller (30) may obtain data relating to the destination selected if the waiting passenger used an external destination entry device, or an inferred destination if the waiting passenger used an up/down call signal.

Upon obtaining the suitable inputs, the controller (30) would assign a value to $HC_x$. This step may encompass situations where a value for $HC_x$ has already been assigned. In this situation, the controller (30) would merely obtain the pre-programmed value and use it as the value of $HC_x$. In other versions, the controller (30) may use various inputs to assign a value to $HC_x$. For example, the controller (30) may assign a value to $HC_x$ based on the time of day or the current status of elevators. The controller (30) may assign a higher value to $HC_x$ where the elevators are at a high capacity. It will be understood by those skilled in the art that various techniques and systems may be used to judge an elevator's system capacity such as evaluating the number of current hall calls, current passengers, and waiting passengers.

After assigning a value to $HC_x$, the controller (30) calculates a CC value for each elevator car using any suitable formula. For example, equations (3) and (4) (shown below) may be used. Once calculated, the controller (30) may then assign the elevator car with the lowest CC value to respond to the call signal.

As mentioned, the values associated with $HC_x$ may correspond to particular times of the day and/or conditions under which the elevator is operating. For example, a classification system may include the following, where the value of (x) equals:

(1) U=Up-Peak
(2) D=Down-Peak
(3) O=Off-Peak
(4) L=Lunch
(5) I=Interfloor
(6) S=Special In one version, up-peak (U) defines when the elevator system is at or close to full capacity with passengers traveling in a generally upwards direction relative to the lobby. One particular example of an up peak situation is a weekday morning at a commercial building when almost all employees arrive at work and ride the elevators to their respective floors. On a scale of 0-1, a value for $HC_U$ may range, for example, from 0.75 to 1. It will be understood by those skilled in the art that other suitable values may be used including those that are higher or lower than the ranges provided.

In this version, down-peak (D) defines when the elevator system is at or close to full capacity with passengers traveling in a generally downward direction. One example of a down-peak situation would include a weekday evening at a commercial building when almost all employees leave work and ride the elevators down to the lobby. A value of $HC_D$ may range, for example, from 0.75 to 1. $HC_D$ may, for example, be the same as that of $HC_U$.

Off-peak (O) refers to when the elevator system is at or close to zero capacity. An off peak environment may include a situation where at least one elevator is idling. One particular example of an off peak situation is a weekend at a commercial building where almost no employees are in the building using an elevator. For these situations, a value of $HC_o$ may range, for example, from 0.00 to 0.25.

Still, other situations exist where values may be pre-assigned for $HC_x$ including lunch periods where increased activity may warrant altering the respective inputs used to calculate CC. A special value, $HC_s$, may be used that reflects the handling capacity of an elevator system during certain events or circumstances. Finally, a value, $HC_I$, may be used that reflects that interfloor activity of passengers in selecting different call signals during the ride and/or the activation of new call signals during the ride.

Another version of an equation to calculate CC is shown below in equation (4).

$$CC = \sum_{k=1}^{n} (SDF_k \times HC_x) + EWT + (HC_x \times ETT) \tag{4}$$

In this version, the value of SDF is multiplied by $HC_x$. In this version, when the value of $HC_x$ is zero, the designation of which elevator car would respond to a call signal would be based solely on the waiting time of the passenger in accordance with perceived efficiencies. For example, the elevator car that could respond to the waiting passenger below thresholds above which passenger inconvenience occurs would be dispatched.

FIG. 5 illustrates a scenario where a number of passengers (A, B-1, B-2, C-1, C-2, and D) are already traveling on Elevators A-D. FIGS. 6-10 illustrate how a new passenger selecting a particular destination may be assigned different elevators depending on numerous factors considered by the controller. FIGS. 5-10 describe how an elevator system may respond differently to the same request depending on factors such as the amount of traffic experienced by the elevator system.

In the elevator system of FIG. 5, the controller is configured to assign the Elevator A-D with the lowest CC value to respond to the call signal from the new waiting passenger. The controller calculates a CC value for each elevator car using a pre-programmed equation and, based upon this calculation, will assign the new passenger the elevator car having the lowest CC value. The tables of FIGS. 6-10 show data related to the calculation of CC for each elevator in the elevator system during a variety of different circumstances. In FIGS. 6-9, Equation (3) is used to calculate the CC for each elevator car in a variety of different circumstances. In FIG. 10, Equation (4) is used to calculate the CC for each elevator car. The value of $HD_x$ used when calculating the data shown in FIGS. 6-10 varies from a minimum value of 0 to a maximum value of 1.

For purposes of illustration, a new passenger may encounter the scenario shown in FIG. 5 and activate a call signal at the $15^{th}$ floor. Using an external destination device the passenger may indicate that they wish to travel from the $15^{th}$ floor to the $26^{th}$ floor. Upon receiving this call signal, the controller calculates a CC for each elevator using a pre-programmed equation and will assign the elevator car with the lowest CC value to respond to the call signal.

The scenario, shown in FIG. 5, that is encountered by the new passenger includes Elevator A traveling upwards from the lobby to the $30^{th}$ floor after picking up Passenger A. Elevator A is not currently assigned to address any call signals. Elevator B is traveling upwards from the $3^{rd}$ floor to the $9^{th}$ floor with Passenger B-1. Elevator B is assigned to respond to a call signal from Passenger B-2 at the $9^{th}$ floor to travel to the $28^{th}$ floor. Elevator C is at the $7^{th}$ floor traveling upwards with Passengers C-1 and C-2 to the $18^{th}$ floor. Elevator C is not currently assigned to address any call signals.

Elevator D is at the $18^{th}$ floor traveling downwards to drop off Passenger D at the lobby. Elevator D is not currently assigned to address any call signals.

As mentioned earlier, equations (3) and (4) read as follows:

$$CC = \sum_{k=1}^{n} SDF_k + EWT + (HC_x \times ETT) \tag{3}$$

where ETD=EWT+($HC_x$×ETT)

$$CC = \sum_{k=1}^{n} (SDF_k \times HC_x) + EWT + (HC_x \times ETT) \tag{4}$$

where ETD=EWT+($HC_x$×ETT)

When the new passenger activates a call signal as described above the various values of SDF, EWT, and ETT for each respective elevator are calculated. In this version, these values remain constant for Elevators A, B, C, and D throughout the data shown in FIGS. 6-10. The term "Modified ETD" as used in FIGS. 7-10 references the value of ETD as lowered by using a lower $HC_x$ coefficient compared to the value of ETD where $HC_x$ equals 1. The term "Modified $SDF_K$" as used in FIG. 10 references the value of $SDF_K$ as lowered by using a lower $HC_x$ coefficient compared to when $HC_x$ equals 1 when using Equation (4) to calculate CC.

FIG. 6 illustrates one set of data input into Equation (3) in accordance with the scenario described in FIG. 5, where a new passenger is attempting to travel from the $15^{th}$ floor to the $26^{th}$ floor. For FIG. 6, $HC_x$ equals 1, which is a value associated with operation during a peak time period. For Elevator A, the CC equals 45.8 seconds, which is calculated by combining the value of $SDF_k$, EWT, and ETT, when $HC_x$ equals 1. The value of EWT for Elevator A equals 12 seconds, which is the estimated time allotted for Elevator A to travel the 60 meters from the lobby to the $15^{th}$ floor at a speed of 5 m/s. The value of ETT is 23.8 seconds, which is the time necessary for Elevator A to travel non-stop from the $15^{th}$ floor to the $26^{th}$ floor (8.8 seconds), the time to allow the new passenger to board the elevator after the doors open until Elevator A resumes traveling to the $18^{th}$ floor (5 seconds), and the time to allow Elevator A to drop off Passenger A at the $18^{th}$ floor (10 seconds). The value of $SDF_k$ for Elevator A is 10 seconds, which represents the delay that would be experienced by Passenger A when picking up the new passenger.

For Elevator B, the CC is 43.4 seconds, which is calculated in the same manner as for elevator A. The value of EWT for Elevator B is 19.6 seconds, which is the time for Elevator B to drop off Passenger B-1 and pick up Passenger B-2 at the $9^{th}$ floor (10 seconds), and the time allotted for Elevator B to travel non-stop from the $3^{rd}$ floor to the $15^{th}$ floor (9.6 seconds). The value of ETT is 13.8 seconds, which is the time allotted for Elevator B to travel non-stop from the $15^{th}$ floor to the $26^{th}$ floor (8.8 seconds) and the time period to allow the new passenger to board Elevator B after the doors open until Elevator B resumes traveling to the $26^{th}$ floor (5 seconds). The value of SDF is 10 seconds, which is the time allotted for the delay experienced by Passenger B-2 when waiting for the new passenger to board Elevator B.

For Elevator C, the value of CC is 48.6 seconds. The value of EWT equals 4.8 seconds. This is the shortest waiting time of any elevator. This value represents the time needed for Elevator C to travel non-stop from the $7^{th}$ floor to the $15^{th}$ floor. The value of ETT equals 23.8 seconds, which is the time needed for Elevator C to travel from the $18^{th}$ floor nonstop to the $26^{th}$ floor (8.8 seconds), the time to allow the new passenger to board Elevator C after the doors open until it resumes traveling to the $18^{th}$ floor (5 seconds), and the time to allow the elevator to drop off Passengers C-1 and C-2 at the $18^{th}$ floor (10 seconds). Finally, the value of $SDF_k$ for Elevator C is 20 seconds. This represents the individual delay that would be suffered by Passengers C-1 and C-2 (10 seconds each) when picking up Passenger W.

For Elevator D, the value of CC equals 50.2 seconds. The value of EWT equals 36.4 seconds, which is the longest waiting time of any elevator in this scenario. This value represents the time allotted for Elevator B to travel from the $18^{th}$ floor to the lobby (14.4 seconds), drop off Passenger D at the lobby (10 seconds), and travel nonstop from the lobby to the $15^{th}$ floor where the new passenger is waiting (12 seconds). The value of ETT equals 13.8 seconds, which is the time needed for Elevator C to travel nonstop from the $15^{th}$ floor to the $26^{th}$ floor (8.8 seconds), and the time to allow the new passenger to board the elevator after the doors open until the elevator resumes traveling to the $18^{th}$ floor (5 seconds). The value of $SDF_k$ for Elevator D is zero because no current passengers of Elevator D would experience any delay if Elevator D were to respond to the new passenger's call signal.

Given these values and as shown in FIG. 6, where $HD_x$ equals 1, the controller would select Elevator B to address the new passenger's call signal. Elevator B has the lowest CC at a value of 43.4 seconds using Equation (3). As mentioned earlier, one version of a system where the value of $HD_x$ may equal 1 is where the elevator system is performing at an Up Peak (U) period or a Down Peak (D) period. During peak times, where $HD_x$ is equal to or close to one, the elevator system will tend to select elevator cars having a lower overall ETD. In the scenario of FIG. 6, Elevator C, which has the lowest ETD, is not chosen because of the relatively high $SDF_k$ associated with inconveniencing multiple passengers.

As shown in FIG. 7, if the value of $HD_x$ is reduced to 0.75 such that less emphasis is placed on the value of ETT, then Elevator A would be assigned to respond to the call signal. Elevator A would then have the lowest CC value of 39.85 seconds. FIG. 7 shows the difference between the calculated values of ETD when the value of $HC_x$ equals 1 and when the value of $HC_x$ equals 0.75. The value of ETD where $HC_x$ equals 1 is labeled the "Original ETD." The value of ETD used to calculate CC in FIG. 7 where $HC_x$ equals 0.75 is referred to as the "Modified ETD." As shown in FIG. 7, lowering the value of $HD_x$ does not substantially impact the value of ETD for Elevator D because Elevator D's value of ETD is largely comprised of a waiting time of 36.4 seconds. However, using a lower value for $HD_x$ most greatly impacts Elevators A and C because these elevators have the lengthiest values for ETT.

As shown in FIG. 8, if the value of $HD_x$ is reduced to 0.5, Elevator A would remain assigned to respond to the call signal as shown in FIG. 8 because the Elevator A would have the lowest CC value of 33.9 seconds. The same selection of Elevator A would be made if the value of $HD_x$ were to be reduced to zero as shown in FIG. 9. An $HD_x$ of zero would reflect an off-peak time period.

FIG. 10 illustrates the application of Equation (4) to the scenario of FIG. 5. By making $HD_x$ equal to 0.5, the controller would assign Elevator C to respond to the call signal. As shown in FIG. 10, Elevator C's CC value is the lowest by having a value of 26.7 seconds. The next closest CC value is 28.9 seconds for Elevator A.

As mentioned earlier, the term "Modified $SDF_K$" refers to the value of $SDF_K$ as affected by multiplying the original value by $HC_x$. Equation (4) reduces the emphasis placed on $SDF_K$ when calculating CC as shown in FIG. 10 when comparing the respective values for $SDF_K$ and the modified $SDF_K$ for Elevators A, B, and C. The value of $SDF_K$ for Elevator D was unaffected by adjusting the value of $HD_x$ as its value was zero. As shown in FIG. 10, Elevator C's original value for $SDF_K$ is the highest due to Passengers C-1 and C-2 being burdened by stopping at the $15^{th}$ floor to pick up Passenger W. Therefore, reducing the emphasis placed on $SDF_K$ when calculating CC substantially impacts the CC value for Elevator C.

It will be understood that still other equations for calculating the value of CC exist including equation (5) listed below.

$$CC = \sum_{k=1}^{n} SDF_k + (EWT \times HC_x) + ETT \tag{5}$$

In this equation, the value of EWT is multiplied by $HC_x$, where $HC_x$ could range from 0-1 depending upon the emphasis to be placed on EWT when calculating an elevator's CC. Please also note that other techniques and systems may be used for formulating $SDF_k$, EWT, and $HC_x$. For example, the value of $SDF_k$ may include whether a waiting passenger will experience degradation in service.

The versions presented in this disclosure are described by way of example only. Having shown and described various versions, further adaptations of the methods and systems described herein may be accomplished by appropriate modifications by one of ordinary skill in the art without departing from the scope of the invention defined by the claim below. Several of such potential modifications have been mentioned, and others will be apparent to those skilled in the art. For instance, the examples, embodiments, ratios, steps, and the like discussed above may be illustrative and not required. Accordingly, the scope of the present invention should be considered in terms of the following claims and is understood not to be limited to the details of structure and operation shown and described in the specification and drawings.

What is claimed is:

1. A method for assigning a new hall call to one of a plurality of elevator cars in an elevator system comprising the steps of:

(a) providing a controller, the controller configure to control the elevator system;

(b) receiving a hall call signal, the hall call signal originating at an elevator landing;

(c) transmitting the hall call to the controller;

(d) programming the controller with an estimated wait time (EWT) threshold, wherein the EWT threshold is a time value above which a passenger is likely to become impatient waiting for one of the plurality of elevator cars to arrive;

(e) programming the controller with an estimated travel time (ETT) threshold, wherein the ETT threshold is a time value above which the passenger is likely to become impatient waiting for their elevator car to arrive at its destination;

(f) calculating an estimated wait time (EWT) for each of the plurality of elevator cars;

(g) calculating an estimated travel time (ETT) for each of the plurality of elevator cars;

(h) determining whether the EWT for each of the plurality of elevator cars is below the EWT threshold;

(i) determining whether the ETT for each of the plurality of elevator cars is below the ETT threshold; and (j) assigning one of the plurality of elevator cars to the hall call by factoring in whether the EWT and ETT for each one of the plurality of elevator cars are below the EWT threshold and the ETT threshold.

2. The method of claim 1, wherein the step of assigning one of the plurality of elevators to the hall call comprises assigning the one of the plurality of elevator cars to the hall call that is below the EWT threshold, below the ETT threshold, and has the shortest estimated time to destination (ETD).

3. The method of claim 1, wherein the step of assigning one of the plurality of elevators to the hall call comprises assigning the one of the plurality of elevator cars to the hall call that is below the EWT threshold and has the shortest estimated time to destination (ETD).

4. The method of claim 1, wherein the step of assigning one of the plurality of elevators to the hall call comprises assigning the one of the plurality of elevator cars to the hall call that is below the ETT threshold and has the shortest estimated time to destination (ETD).

5. The method of claim 1, wherein the step of assigning one of the plurality of elevators to the hall call comprises;

(i) assigning a value to a handling capacity coefficient (HCx) to reflect current traffic conditions of the elevator system; and (ii) factoring the HCx into a determination of which one of the plurality of elevators to assign to the hall call.

6. The method of claim 5, wherein the HCx is a value that, during peak operating times of the elevator system, places less emphasis on whether each one of the plurality of elevator cars is below the ETT threshold and the ETW threshold and more emphasis on the shortest estimated time to destination (ETD).

7. The method of claim 5, wherein the HCx is a value that, during off-peak operating times of the elevator system, places more emphasis on whether each one of the plurality of elevator cars is below the ETT threshold and the ETW threshold and less emphasis on the shortest estimated time to destination (ETD).

* * * * *